US005142324A

United States Patent [19]

Ito

[11] Patent Number: 5,142,324

[45] Date of Patent: Aug. 25, 1992

[54] SECURITY DEVICE FOR RENTAL PHOTOCOPYING MACHINES

[75] Inventor: Masazumi Ito, Osaka, Japan

[73] Assignee: Minolta Camera Co., Ltd., Osaka, Japan

[21] Appl. No.: 688,663

[22] Filed: Apr. 18, 1991

Related U.S. Application Data

[63] Continuation of Ser. No. 241,302, Sep. 7, 1988, abandoned.

[30] Foreign Application Priority Data

Sep. 7, 1987 [JP] Japan ..... 62-2232920

[51] Int. Cl.[5] ..... G03G 15/00

[52] U.S. Cl. ..... 355/206; 355/209; 355/201

[58] Field of Search ..... 355/200, 201, 202, 204, 355/206, 208, 209, 308, 313; 368/10; 340/309.15; 307/141.8

[56] References Cited

U.S. PATENT DOCUMENTS 4,624,578 11/1986 Green ..... 368/10
4,677,310 6/1987 Midorikawa et al. .... 355/202 g37X

FOREIGN PATENT DOCUMENTS 60-130782 7/1985 Japan .
62-113165 5/1987 Japan .

*Primary Examiner*—Joan H. Pendegrass
*Attorney, Agent, or Firm*—Price, Gess & Ubell

[57] ABSTRACT

An image forming apparatus having a device for forming an image on a copy sheet, an input device for designating a due data, a device for storing the due date designated through the input device and a mechanism for inhibiting an operation of the image forming device after a lapse of the designated due date stored in the storing device. The apparatus, when rented, enables a rental firm to supervise the rented apparatus by preventing an unauthorized or overdue use thereof through a service person who is to regularly visit the user and check the apparatus.

7 Claims, 12 Drawing Sheets

Fig. 3-a
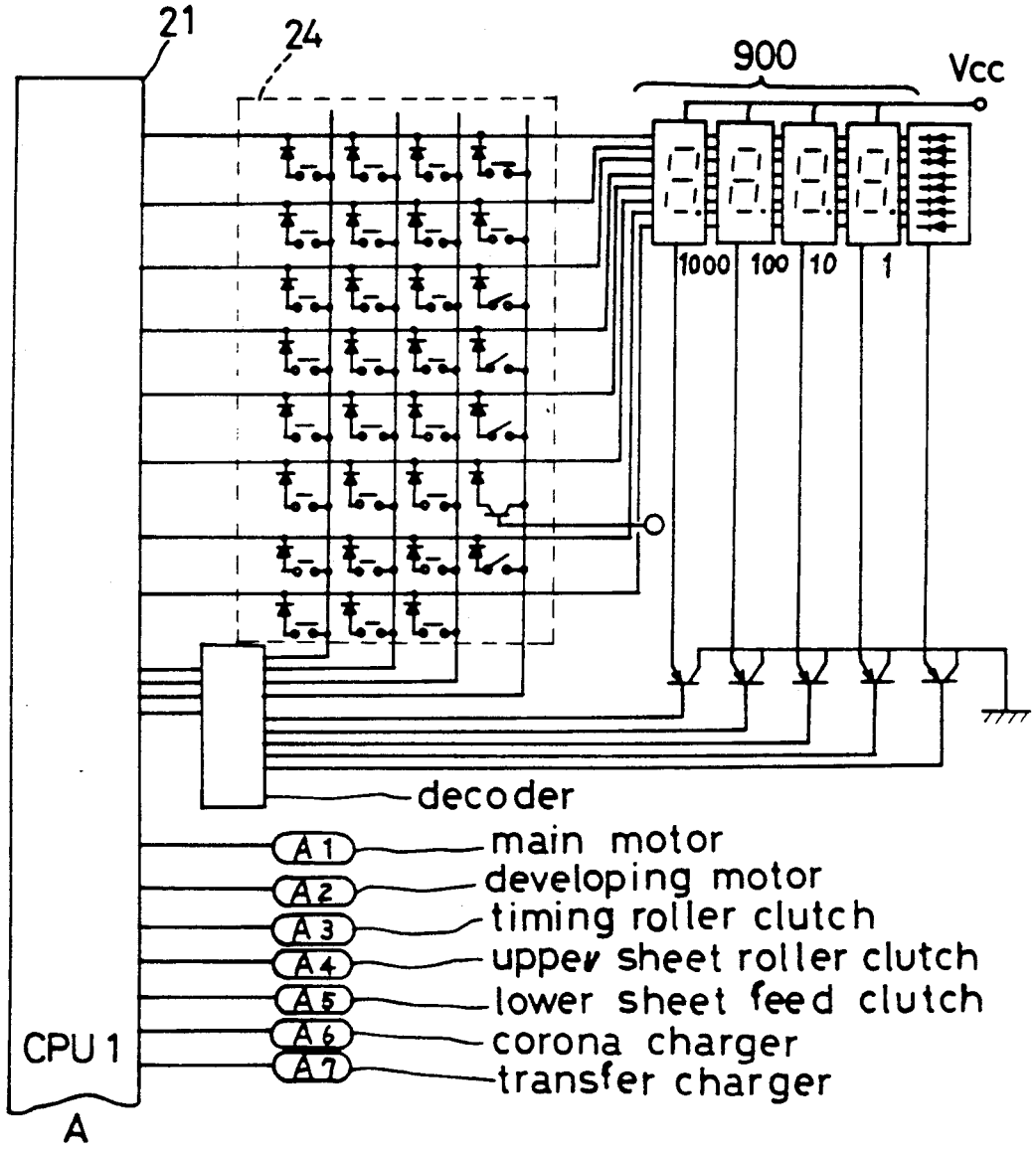

Fig. 3-b
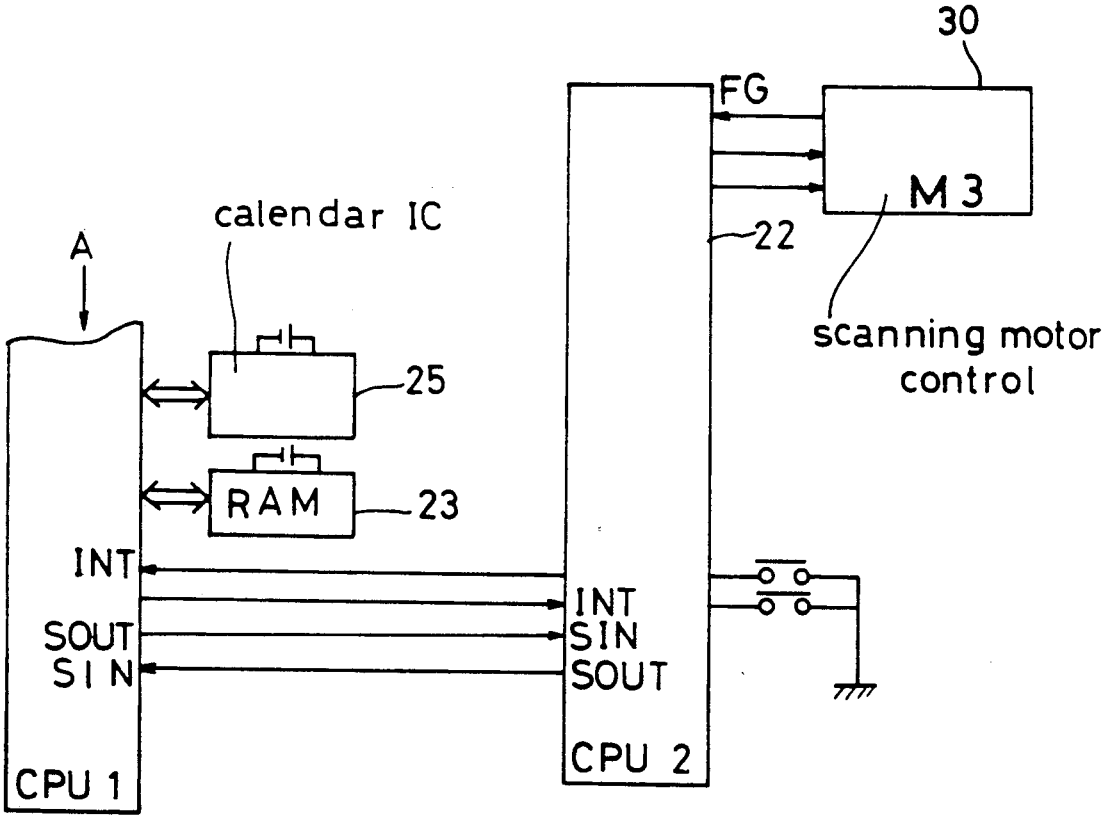

Fig. 5-a
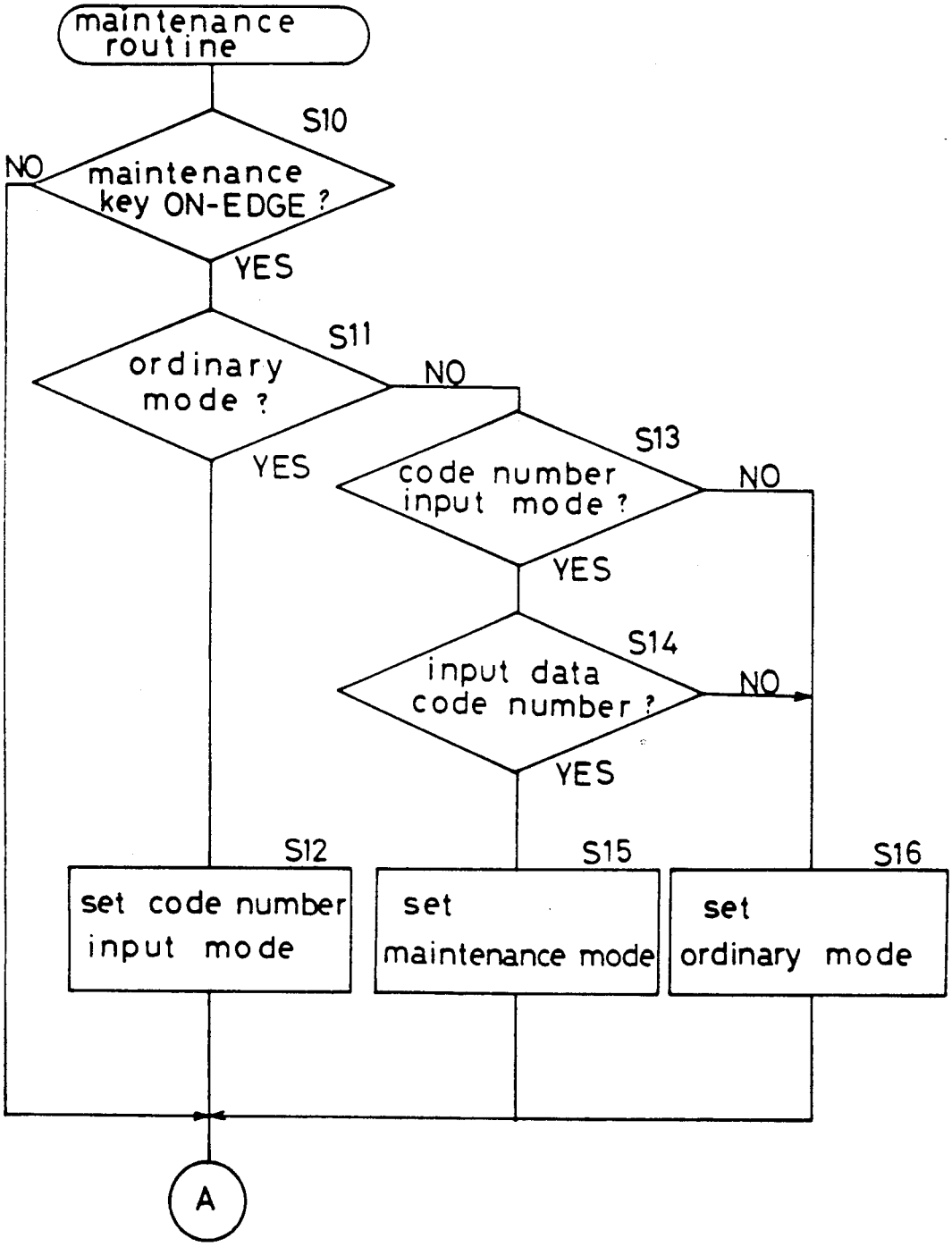

Fig. 5-b
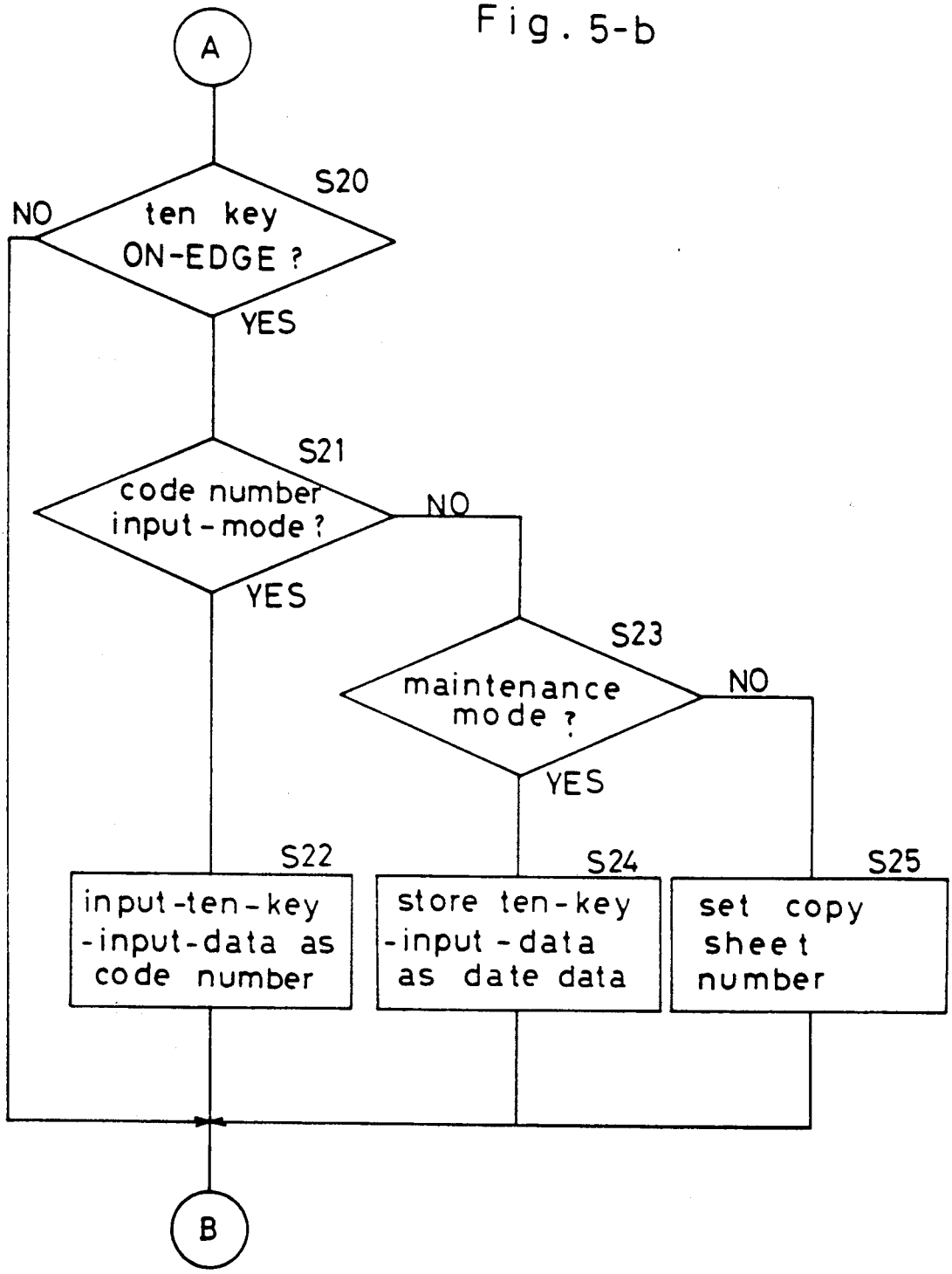

Fig. 5-c
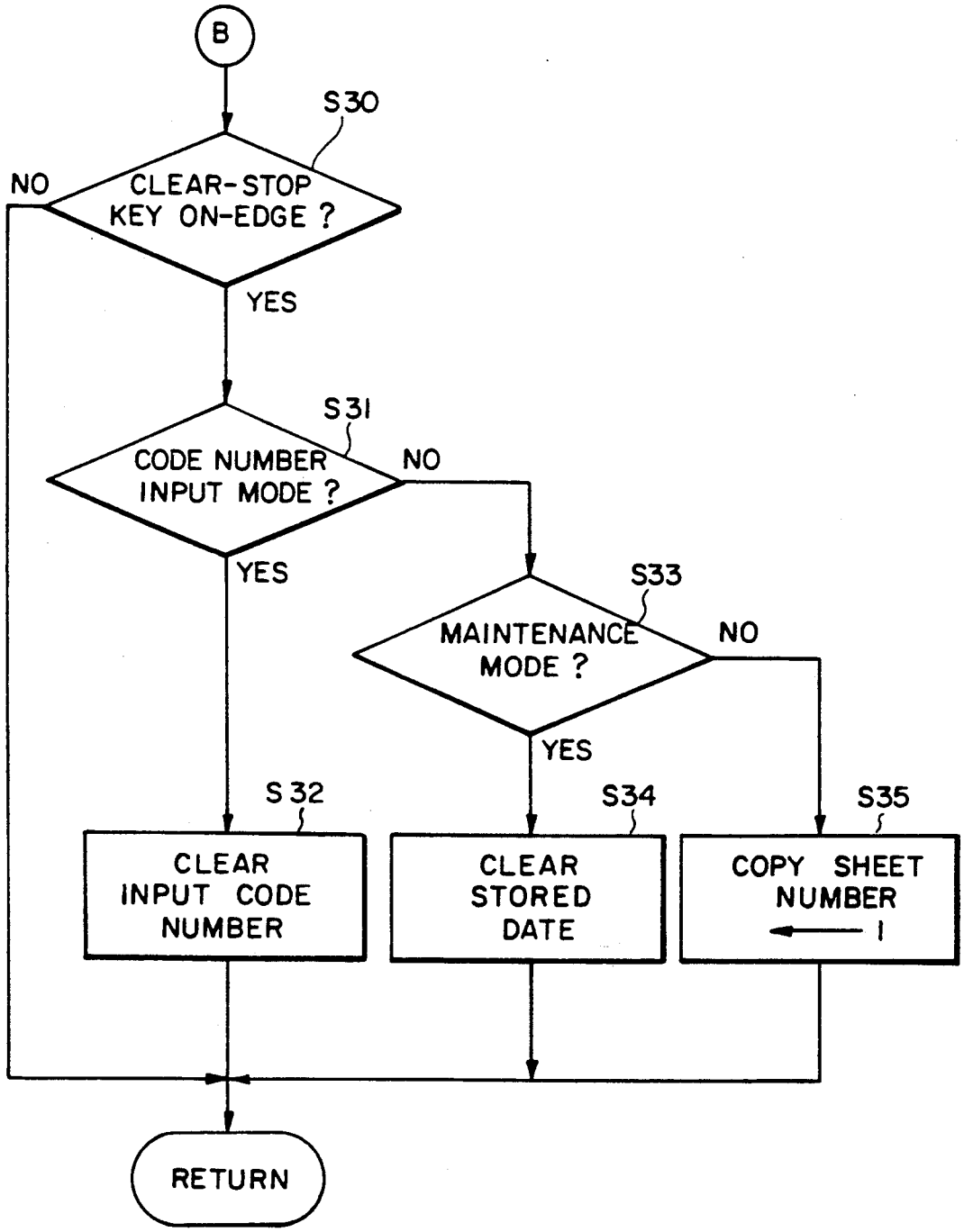

Fig. 6-a
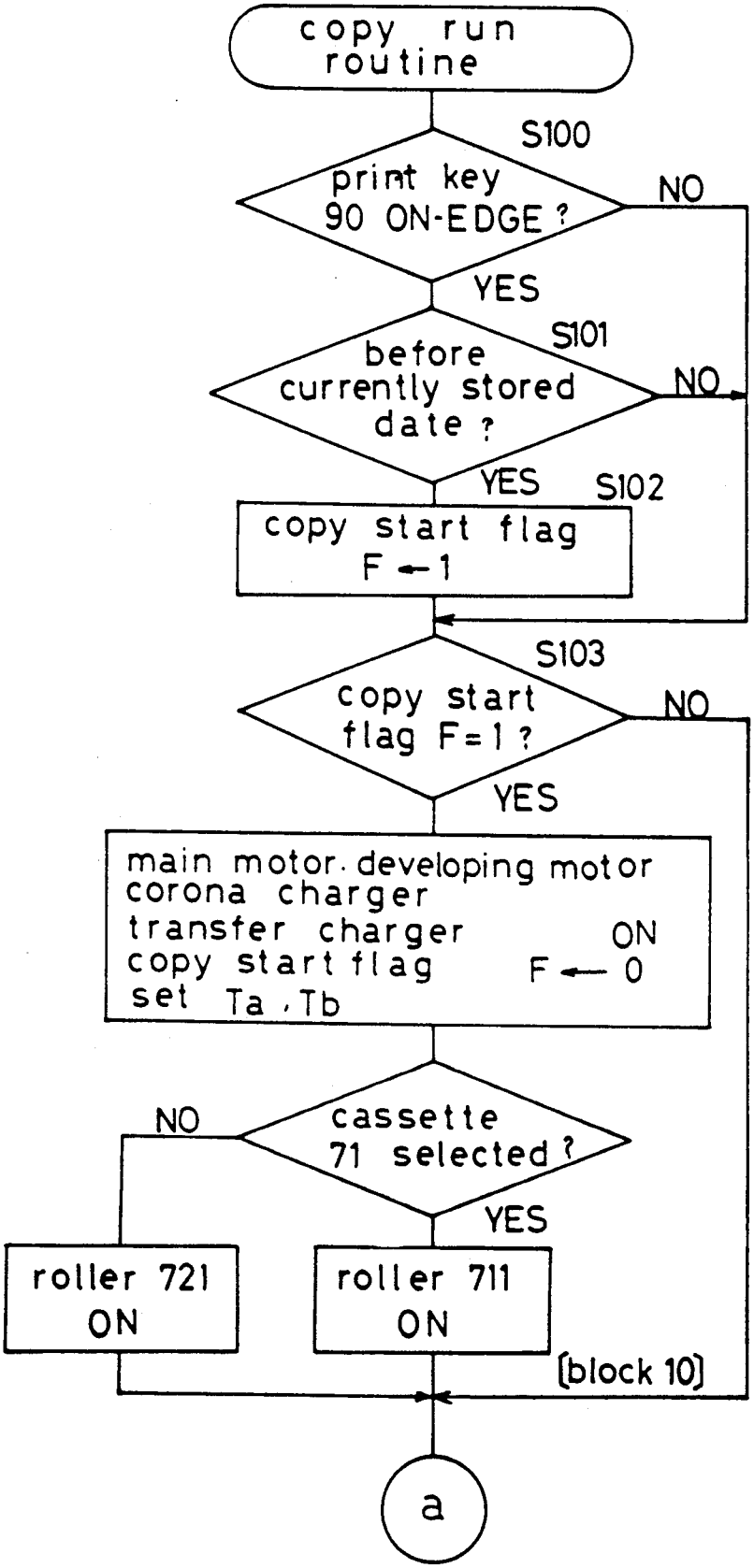

Fig. 6-c
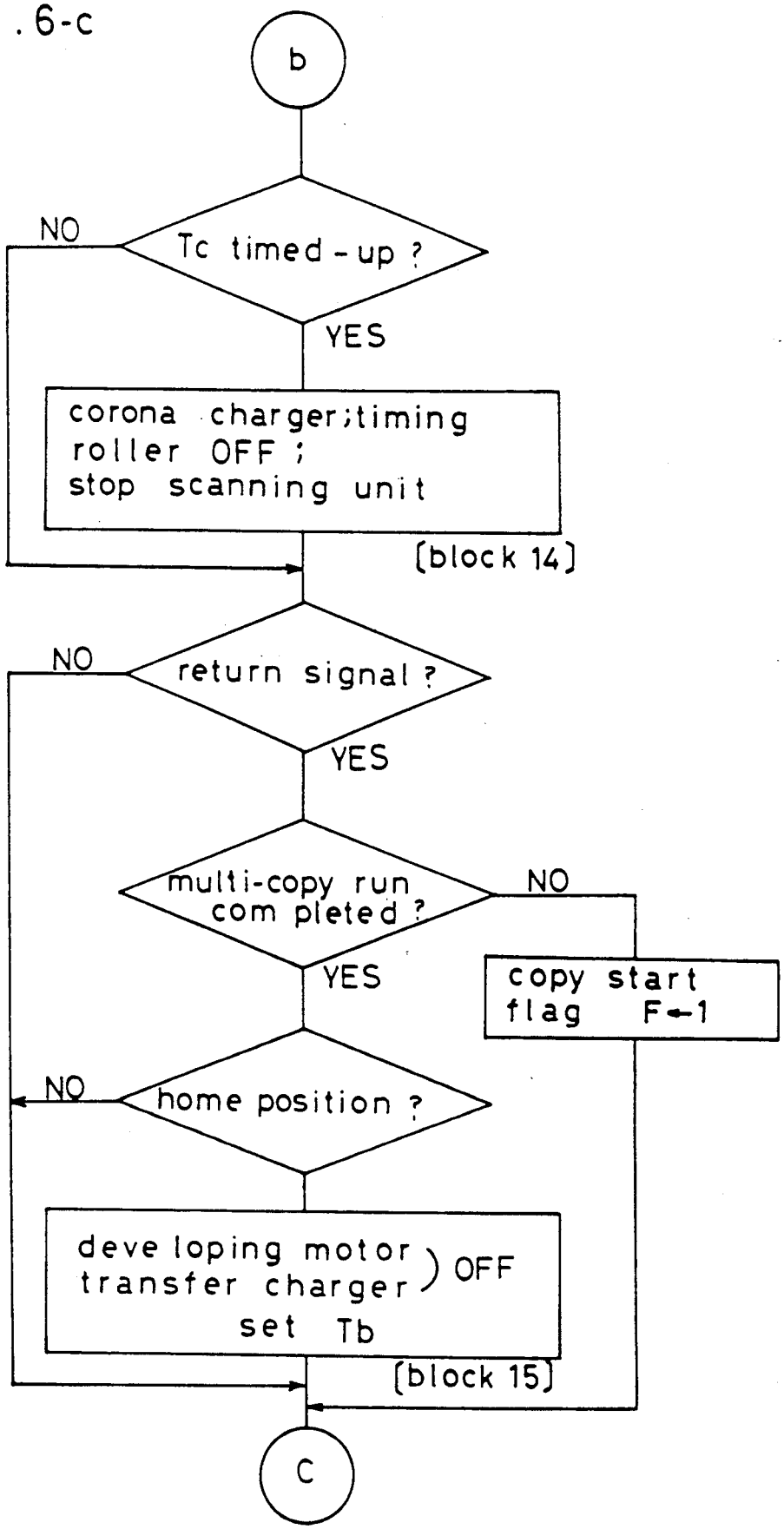

Fig.6-b
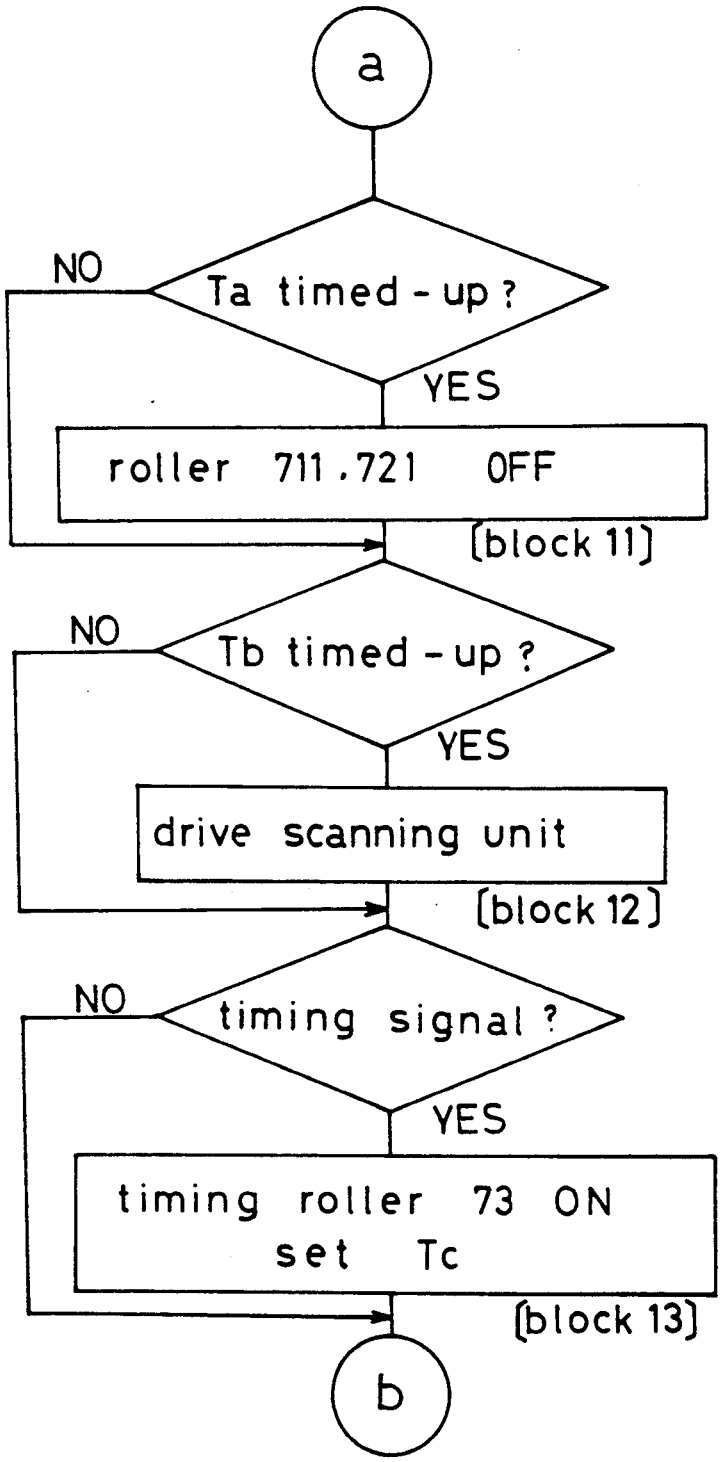

Fig. 6-d
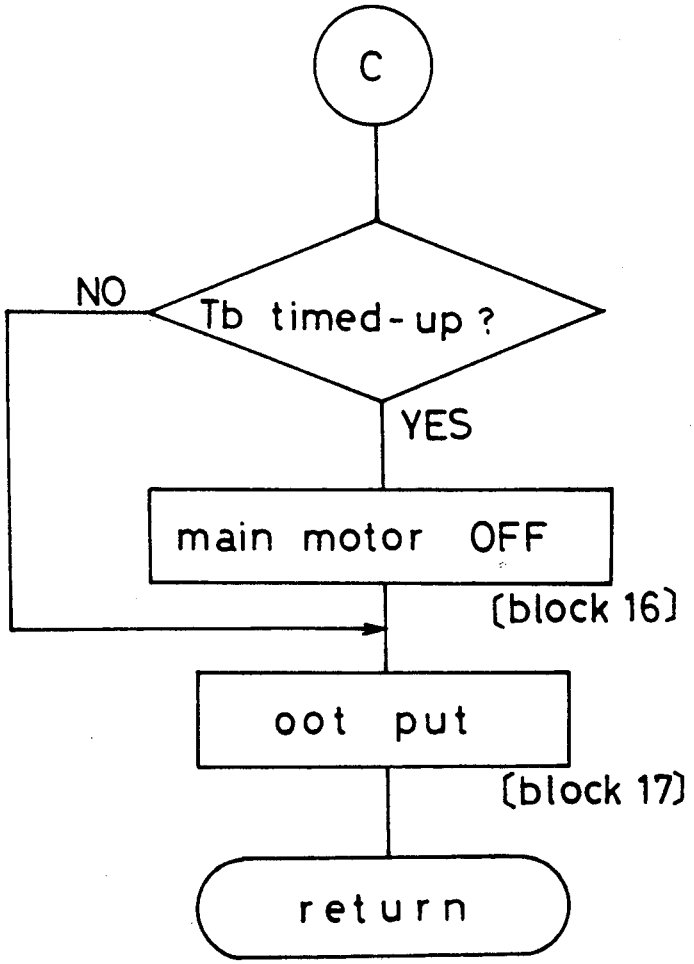

SECURITY DEVICE FOR RENTAL PHOTOCOPYING MACHINES

This is a continuation of application Ser. No. 241,302, filed on Sep. 7, 1988, now abandoned, for a SECURITY DEVICE FOR RENTAL PHOTOCOPYING MACHINE.

BACKGROUND OF THE INVENTION

1. Field of the Invention

The present invention relates to an electrophotographic image forming apparatus such as a laser beam printer, copying machine or the like, and more particularly to an image forming apparatus of the above-noted type for rental use having a security mechanism against theft or any unauthorized or overdue use of the apparatus.

2. Description of the Prior Art

In the case of a copying machine, it is a common practice for a user to rent the machine from a rental firm.

In such case, the rental firm needs to constantly keep track of the residence of the user and also the installation site of the rented copy machine. In actual situations; however, there are many occasions where the rental firm loses track of the installation site of the machine together with the user's residence for various reasons or where the rented machine is unduely resold to another user.

On the other hand, for the electrophotographic image forming apparatus (e.g. a copying machine) of recent make except for small-sized special ones, occasional maintenance operations by a service person are almost requisite for maintaining their copy image quality at a certain level over an extended use.

Therefore, a service person visits the user at appropriate intervals to carry out the maintenance operations on the machine.

The prior art has not yet provided any technical solution for effectively preventing such unnotified or unauthorized transfer of the rented machine. This lack of effective security measure necessarily causes the rental firm to be precautious in judging the customer and causes also some hesitence in renting a machine on the part of the customer who anticipates troublesome procedures required for renting the machine.

In view of the above-described state of the art, the primary object of the present invention is to provide an electrophotographic image forming apparatus which may be readily placed under constant record or supervison of, e.g. a rental firm through a service person who is to regularly visit the user to carry out a maintenance operation on the apparatus.

SUMMARY OF THE INVENTION

In order to accomplish the above-noted object, an image forming apparatus related to the present invention comprises: means for forming an image on a copy sheet; input means for designating a due date; means for storing the due date designated through the input means; and means for inhibiting an operation of the image forming means after a lapse of the designated due date stored in the storing means.

With the above-described construction, the image forming apparatus is inhibited from its operation after the lapse of the input, i.e. designated due date.

Accordingly; for example, a user who rented the image forming apparatus from a rental firm can not use the apparatus after the due date input thereto without authorization of, e.g. a service person. Therefore, the apparatus may be substantially placed under constant supervison of the service person and consequently of the authorizing firm by which the service person is employed, thereby effectively preventing the aforementioned security troubles inherent in the prior-art apparatuses.

DESCRIPTION OF THE PREFERRED EMBODIMENT

One preferred embodiment of an electrophotographic image forming apparatus being embodied as a copying machine will be particularly described hereinafter with reference to the accompanying drawings.

Figure 1:
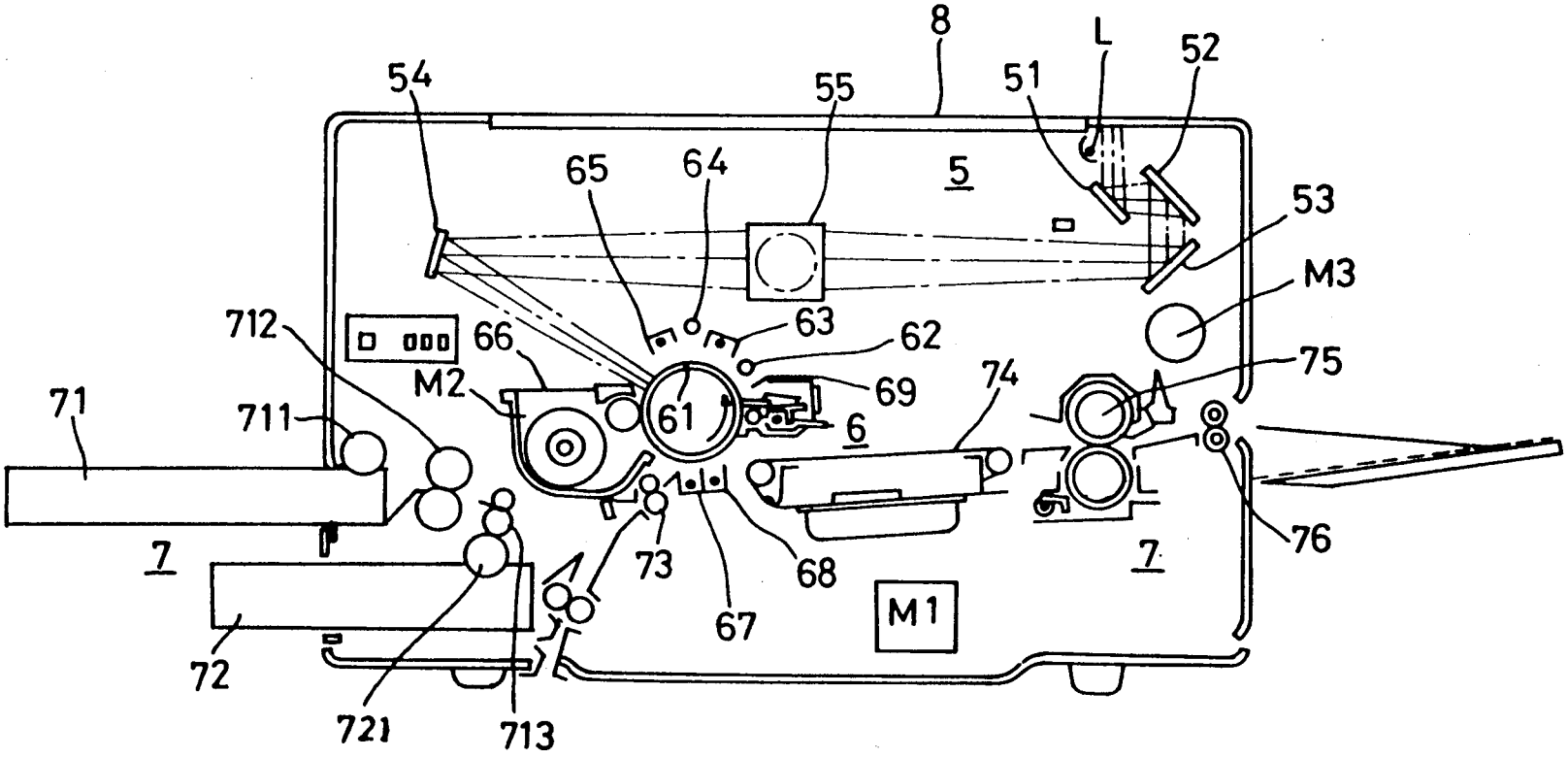
FIG. 1 is a view schematically showing a construction of a copying machine as one preferred embodiment of an electrophotographic image forming apparatus related to the present invention.

FIG. 1 schematically shows a construction of a body of the copying machine.

As shown, the machine body includes a glass document table 8 for mounting an original document thereon, an optical unit 5 (51 through 55) for scanning the original document and then transferring an image thereof, an imaging station 6 (61 through 69) for effecting reproduction of the original image on a copy sheet and a sheet feed/exhaust unit 7 (71 through 76, 711 and 721) for feeding and exhausting the copy sheet.

More particularly, the optical unit 5 includes a light source L, mirrors 51, 52, 53 and 54 and a lens 55. In operation, the unit 5 moves back and forth along a lower face of the document table 8 thereby carrying out a scanning by exposure on an information-bearing face of the document. That is, the reflection light from the document is reflected by the mirrors 51, 52 and 53 and then this light passes through the lens 55 to be again reflected by the mirror 54 and reaches a photoconductive drum 61 to form an electrostatic latent image on a circumferential face of the same. Incidentally, the mirrors 51, 52 and 53 are all driven in cooperation by a scanning motor M3.

The imaging station 6 includes the photoconductive drum 61 rotatable in a direction of arrow, and further includes, in the periphery of the drum 61, a main eraser lamp 62, auxiliary corona charger 63, auxiliary eraser lamp 64, main corona charger 65, sheet-separator charger 68 and a blade type cleaning device 69. The photoconductive drum 61 has its circumferential face covered with a photoconductive layer, which layer is uniformly charged as the drum 61 passes the eraser lamps 62 and 64, and the corona chargers 63 and 65 and an electrostatic latent image is formed thereon through a slit exposure by the optical unit 5. Then, this electrostatic latent image is developed into a toner-powder image at a developing station 66 and the toner-powder image is transferred by the transfer charger 67 onto a copy sheet fed from the sheet feed/exhaust unit 7.

The sheet feed/exhaust unit 7 includes sheet cassettes 71 and 72, their respective feed roller pairs 711 and 721, transport roller pairs 712 and 713, timing roller pair 73, transport belt 74, fusing device 75 and an exhaust roller pair 76, all of which are driven by a main motor M1.

Figure 2:
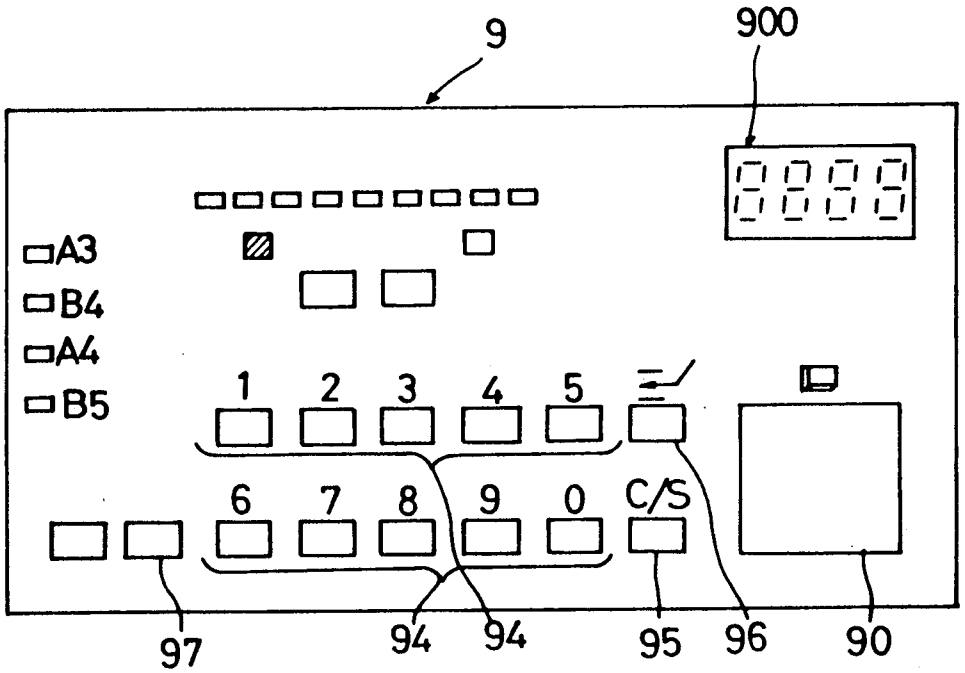
FIG. 2 is a plan view of a control panel of the copying machine, FIGS. 3-*a* and 3-*b* are a diagram of input/output construction of a control unit of the copying machine.

FIG. 2 is a plan view of a control panel 9 of the copying machine.

As illustrated, the control panel 9 includes a print key for initiating a copy run, a group of ten keys (each corresponding to numerical values of 1, 2 . . . 9, 0) 94 for inputting a desired number of copies, clear-stop key 95, interruption key 96, maintenance key 97 and a 4-place-7-segment display panel 900 for displaying an input copy sheet number.

FIGS 3-*a* and 3-*b* show an input/output construction of a control unit of the copying machine.

This control unit includes a first central processing unit (CPU) 21, second CPU 22, switch matrix 24, calendar IC 22 and a random access memory (RAM) 23.

The first CPU 21 is operable to control drivings of the imaging station 6 and of sheet feed/exhaust unit 7 (driven respectively by the motors M2 and M1), a number displaying of the display panel 900 and to control also the fusing device 75, temperature adjustments and other main operations of the copying machine.

The second CPU 22 is operable to control driving of the scanning motor M3 in response to a signal provided from the first CPU 21.

The calendar IC 25 is backed up by a battery and used for reading a current date timed from an initial date set at, e.g. shipping of the copying machine. Also, this calendar IC 25 comprises a commercially available conventional IC incorporating a crystal oscillator type clock and a calendar program.

The RAM 23 is used for writing and reading of various data such as copy-run control data.

The switch matrix 24 includes various switches of the control panel 9 and other switches provided inside the copying machine body. In operation, a user may input a set or selected mode or information concerning copying conditions to the first CPU 21 through this switch matrix 24.

Referring further to FIGS. 3-*a* and 3-*b*, a reference numeral 30 denotes a drive circuit for the scanning motor M3, and output terminals denoted by marks A1 through A7 of the first CPU 21 are respectively connected to bases of drive-switching transistors for the main motor M1, the developing motor M2, a clutch of the timing roller pair 73, a clutch of the feed roller pair 711, a clutch of the other feed roller pair 721, the corona charger 65, and for the transfer charger 67.

Figure 4:
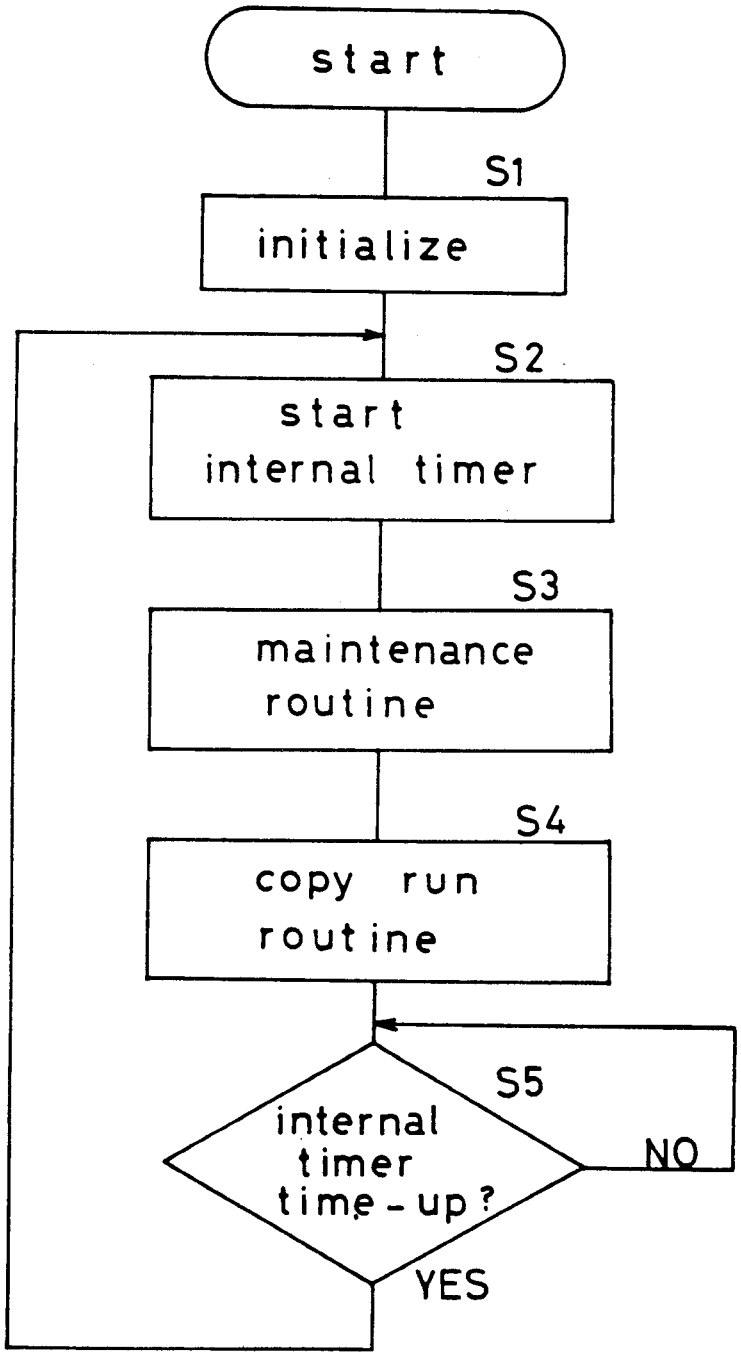
FIG. 4 is a flow chart illustrating a main routine executed by a first central processing unit (CPU), FIGS. 5-*a*, 5-*b* and 5-*c* are a flow chart particularly illustrating a maintenance routine effected also by the first CPU, and FIGS. 6-*a*, 6-*b*, 6-*c* and 6-*d* are a flow chart illustrating a copy-run routine effected also by the first CPU.

Next, a main routine executed by the first central processing unit 21 will be described with reference to a flow chart of FIG. 4.

As the first CPU 21 initiates this main routine upon power-ON of the copying machine, initial conditions are set at step #1. That is, the random-access-memory, i.e. RAM 23, various registers and timers are initialized and also a copying mode of the copying machine is set to a standard mode (e.g. copy sheet number 1, copy sheet size B4, etc.).

At step #2, an internal timer for regulating a time period of one routine is started. At the following steps #3, #4, #4 and #5, the CPU 21 executes a maintenance routine, copy-run routine and other routines, respectively. Then, at step #5, it is judged whether the internal timer started at step #2 has timed-up or not. If so, at step #6, the process returns to step #2.

FIGS. 5-*a*, 5-*b* and 5-*c* are a flow chart particularly illustrating a maintenance routine.

Before describing this subroutine, terms 'ON-EDGE' and 'OFF-EDGE' to be used hereinafter will be defined.

The term 'ON-EDGE' used here is to be understood to represent condition change of a switch, sensor, signal or the like from its 'OFF' to 'ON' state.

Whereas, the term 'OFF-EDGE' used here is to be understood to represent condition change of the same from its 'ON' to 'OFF' state.

In this subroutine, at step #10, presence of 'ON-EDGE' of a maintenance key 97 is judged. In the case of the presence, it is then judged at step #11 whether the operational mode is the ordinary mode or not. In the case of the ordinary mode, the operational mode is switched over to a code number input mode at step #12. In the opposite case; on the other hand, if the current operational mode is the code number input mode, data input through the ten keys is compared at step #14 with a code number pre-stored in the memory. If these match each other, the operational mode is switched to a maintenance mode at step #15. On the other hand, if it is judged at step #13 that the current operational mode is not the code number input mode or if it is judged at step #14 that the input data does not match the pre-stored code number, the operational mode is set to the ordinary mode at step #16. In this way, for setting the maintenance mode thereby to designate a due date, the predetermined input code number must be input, which mechanism inhibits an ordinary user from unduely changing the due date.

At step #20, presence of ON-EDGE of the ten keys is judged. In the case of the presence, it is judged at step #21 whether the operational mode is the code number input mode or not. If so, the ten key input data is stored as a code number at step #22. On the other hand, if it is judged at step #21 that the current operational mode is not the code number input mode; then, it is judged at step #23 whether the mode is the maintenance mode or not. If so, the ten-keys input data is stored as the due date data at step #24. More specifically, if the input data is '19900819' for example, this is decoded and stored as 'Aug. 19 of year 1990' at step #24. Incidentally, the service person may erroneously input by the ten keys new date data which date is before the present date. Then, in order to avoid any inconvenience resulting from such mis-input operation, an arrangement as follow is possible; that is, the newly input date data is compared with the present date read from the calendar IC, and if the former precedes the latter, for example, the display panel is illuminated for providing a warning. On the other hand, if it is judged at step #23 that the mode is not the maintenance mode, the ten-keys input data is decoded and stored at step #25 as a copy sheet number.

In succession, at step #30, presence of ON-EDGE of the clear-stop key is judged. In the case of the presence, it is judged at step #31 whether the operational mode is the code number input mode or not. If so, the presently stored code number is cleared at step #32. If not; on the other hand, it is judged at step #33 whether the operational mode is the maintenance mode or not. If so, the date data stored at the RAM 23 is cleared at step #34. If not, the copy sheet number is set to one (sheet) at step #35.

FIGS. 6-*a*, 6-*b*, 6-*c* and 6-*d* are a flow chart illustrating in details the copy-run routine. In this routine, first at step #100, presence of ON-EDGE of the print key 90 is judged. In the case of the presence, it is judged at step #101 whether the present date precedes the stored due date or not. If so, a copy start flag is set at step #102.

At step #103, it is judged whether the copy start flag is set or not. If so, the process goes on to block 10 and the various image forming components are turned ON. That is to say, if the present date passes the stored due date, the copy-start flag is not set with an operation of the print key 90, whereby a copying operation is inhibited thereafter.

In block 10, the main motor M1, developing motor M2, corona charger 62 and the transfer charger 64 are energized and the copy start flag is set to OFF. Also, a timer Ta (for stopping the feed rollers), and a timer Tb(for starting an exposure scanning) are started and also the clutch of the feed roller pair of a selected sheet cassette is engaged.

In block 11, timing-up of the timer Ta is judged, and upon this timing-up, the above clutch of the feed roller pair is disengaged to stop the copy-sheet feeding operation from the sheet cassette.

In block 12, timing-up of the timer Tb is judged and a start of scanning operation for a copy run is instructed to the second CPU 22.

In block 13, in response to a timing signal transmitted from the second CPU in the course of the above scanning operation, the clutch of the timing roller 73 is engaged to transport a copy sheet in synchronism with an image on the photoconductive drum 61 and also a timer Tc (for stopping copying and scanning operations) is started.

In block 14, timing-up of the timer Tc is judged, and upon this timing-up, the corona charger 62 is disenergized, the clutch of the timing roller 73 is disengaged and also the scanning motor M3 is disenergized.

In block 15, it is judged whether the scanning unit has returned to its home position or not in the course of a multi-copy run. If so, the developing motor M2 and the transfer charger 64 are disenergized. On the other hand, if it is judged that the copying machine is still in the course of a multicopy run, i.e. the machine is to provide further number of copies, the copy-start flag is set again and also a timer Td(for stopping the main motor) is started.

In block 16, it is judged whether the timer Td has timed up or not. If so, the main motor M1 is disenergized.

In block 17, varius output operations are carried out. The above concludes one copy run.

In the above embodiment, the usable time period for a user of the electrophotographic image forming apparatus is set based on the rental firm's designation of the due date. In place of this, if the rental firm designates and sets a term including a certain number of days, it becomes also possible to achieve the primary object of the present invention which is to provide such an electrophotographic image forming apparatus as may be placed under constant supervision of the rental firm.

What is claimed is:

1. An improved image forming apparatus, the improvement comprising:

a ten key for allowing an operator to input one of a number of copies, an authorization code, and a due date;

mode setting means including a mode select key, each depression of the mode select key successively setting one of an ordinary mode during which the number of copies may be input and a code number input mode during which the authorization code may be input, and, if enabled, a maintenance mode during which the due date may be input;

discriminating means for discriminating that the ten key is being operated by an authorized user based on the authorization code input through the ten key during the code number input mode and, if discriminated that the ten key is being operated by the authorized user, for enabling the mode setting means to set the maintenance mode;

storing means for storing a due date input through the ten key only when the maintenance mode is set;

counting means for counting the actual date;

comparing means for comparing the actual date and the due date stored by the storing means and for outputting an indication and thereof;

inhibiting means for inhibiting an operation of the image forming apparatus when the comparing means indicates that the actual date is equal to or greater than the due date until a new due date, equal to or greater than the actual date, is input by the authorized user through the ten key and stored by the storing means.

2. The image forming apparatus of claim 1, further comprising means for warning the authorized user that due date input during the maintenance mode precedes the actual date.

3. An image forming apparatus comprising:

a key switch, located on a control panel of the image forming apparatus, for allowing an operator to input one of a number of copies and a due date;

mode setting means for allowing the operator to set one of an ordinary mode during which the number of copies may be input by the key switch and, if enabled, a maintenance mode during which the due date may be input by the key switch;

discriminating means for discriminating that the key switch is being operated by an authorized user and, if discriminated that the key switch is being operated by the authorized user, for enabling the mode setting means to set the maintenance mode;

storing means for storing a due date input through the key switch only when the maintenance mode is set;

counting means for counting the actual date;

comparing means for comparing the actual date and the due date stored by the storing means and for outputting an indication thereof, and inhibiting means for inhibiting an operation of the image forming apparatus when the comparing means indicates that the actual date is equal to or greater than the due date until a new due date, equal to or greater than the actual date, is input by the authorized user through the key switch and stored by the storing means.

4. The image forming apparatus of claim 3, further comprising means for warning the authorized user that the due date input during the maintenance mode precedes the actual date.

5. The image forming apparatus comprising:

a key switch, located on a control panel of the image forming apparatus, for allowing an operator to input one of a number of copies, an authorization code, and a due date;

mode setting means for allowing the operator to set one of an ordinary mode during which the number of copies may be input by the key switch and a code number input mode during which the authorization code may be input by the key switch and, if enabled, a maintenance mode during which the due date may be input by the key switch;

discriminating means for discriminating that the key switch is being operated by an authorized user based on the authorization code input through the key switch during the code number input mode and, if discriminated that the key switch is being operated by the authorized user, for enabling the mode setting means to set the maintenance mode;

storing means for storing a due date input through the key switch only when the maintenance mode is set;

counting means for counting the actual date;

comparing means for comparing the actual date and the due date stored by the storing means and for outputting an indication thereof, and inhibiting means for inhibiting an operation of the image forming apparatus when the comparing means indicates that the actual date is equal to or greater than the due date until a new due date, equal to or greater than the actual date, is input by the authorized user through the key switch and stored by the storing means.

6. The image forming apparatus of claim 5, further comprising means for warning the authorized user that the due date input during the maintenance mode precedes the actual date.

7. The image forming apparatus of claim 5, further comprising means for clearing the due date stored by the storing means during the maintenance mode.

* * * * *